US012434123B2

(12) United States Patent
Facchini

(10) Patent No.: US 12,434,123 B2
(45) Date of Patent: Oct. 7, 2025

(54) GOLF PRACTICE DEVICE

(71) Applicant: Roberto Facchini, Florence (IT)

(72) Inventor: Roberto Facchini, Florence (IT)

( * ) Notice: Subject to any disclaimer, the term of this patent is extended or adjusted under 35 U.S.C. 154(b) by 323 days.

(21) Appl. No.: 18/134,093

(22) Filed: Apr. 13, 2023

(65) Prior Publication Data

US 2023/0338809 A1 Oct. 26, 2023

(30) Foreign Application Priority Data

Apr. 22, 2022 (IT) ..... 10202000007958

(51) Int. Cl.
*A63B 69/36* (2006.01)

(52) U.S. Cl.
CPC ..... *A63B 69/3658* (2013.01)

(58) Field of Classification Search
CPC ..... A63B 69/3658; A63B 2069/401; A63B 2220/30; A63B 2220/31; A63B 2220/78; A63B 57/00; A63B 69/3676; A63B 2071/024; A63B 2210/50; A63B 2225/09
USPC ..... 473/157, 160, 163, 279, 296, 298, 299, 473/404, 407, 198, 405
See application file for complete search history.

(56) References Cited

U.S. PATENT DOCUMENTS 1,662,864 A * 3/1928 Petersen ..... A63F 7/0005 273/119 R
3,215,436 A * 11/1965 Carter ..... A63B 69/3661 273/DIG. 8
3,539,183 A * 11/1970 Lieb ..... A63B 71/0009 473/56
5,358,447 A * 10/1994 Erickson ..... A63D 5/00 473/56
5,586,941 A * 12/1996 Klearman ..... A63B 69/3676 473/181
6,227,981 B1 5/2001 Lizama Troncoso et al.
6,569,026 B1 * 5/2003 Weis ..... A63B 69/3661 473/278
6,749,527 B2 * 6/2004 Hughes ..... A63B 57/00 473/404
8,277,339 B2 10/2012 De La Gandara et al.
2003/0226393 A1 * 12/2003 Pelz ..... A63B 71/0605 73/9
2004/0097303 A1 5/2004 Hughes
2005/0145011 A1 7/2005 Pelz

FOREIGN PATENT DOCUMENTS

GB 2267039 A 5/1995

* cited by examiner

*Primary Examiner* — Nini F Legesse
(74) *Attorney, Agent, or Firm* — Rivka Friedman

(57) ABSTRACT

A golf practice device of the type having an inclined ramp on which to place a golf ball to determine its roll for the purpose of measuring the speed of a green; the device (1) comprises: a straight main body (2) provided with a first pair of rails (20) for rolling the ball; a base body (3), provided with a second pair of rails (30) for rolling the ball and hinged to the main body (2) so as to vary its configuration with respect to the latter.

15 Claims, 7 Drawing Sheets

GOLF PRACTICE DEVICE

Figure 4B:
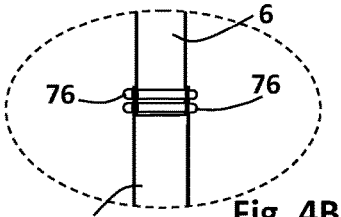

The present invention relates to a golf practice device. In particular, the device in question fits into the technical sector which includes devices known as "stimpmeters", which are devices provided with an inclined ramp on which to place a golf ball to determine its rolling in order to measure the speed of a green.

The green is the landing area of each hole, characterized by a usually uniform and well-maintained turf. It is known that the "putt" (i.e. a shot performed in the green area) is considered by many golfers to be one of the most important shots in golf, also because according to statistics, it is possible to state that the putt represents a part of about 40% of all shots taken, at virtually all levels of play. As an example, in 2016, the average PGA Tour player needed 29 putts to achieve an average score of 70.85 (41% of strokes), while the average player with an index 17 handicap needs 34 putts to achieve the average score of 89 (38% of hits).

Differently configured stimpmeters are known. Patent documents U.S. Pat. Nos. 8,277,339B2, 6,227,981, US2003/0226393, US2005/0145011 and GB2267039 describe devices which can be used for this purpose. Some of the devices described in the prior art documents are characterized by a relatively high constructive complexity, while others are bulky and not easily transportable.

Among the aims of the present invention is that of providing a new device for practicing golf capable of eliminating or at least reducing the drawbacks of the prior art.

This result is obtained by means of a device having the features of claim 1. Other advantageous characteristics of the invention are described in the dependent claims. Among the advantages of the present invention the following can be listed: the device has optimal structural and functional characteristics even though it is made in a relatively simple and economical way since it does not require particular processes such as, for example, the creation of moulded curved portions or in any case with a complex shape; thanks to its relative constructive simplicity it can also be made by non highly specialized personnel; the device provides correct acceleration to the ball thanks to the presence of a straight ramp; the device is made up of hinged or removable portions which allow it to be positioned in a compact rest and transport configuration; the device can be provided with support portions provided with holes for its anchoring to the ground through one or more "tees" or can be used without anchoring on hard ground, for example for indoor use; in an alternative embodiment the perforated portions can be replaced by pointed ends which can be driven into the ground; the device keeps its features unaltered over time, making it resistant to wear.

In practice, the device in question, which has some analogies with a "stimpmeter", is a device for training in the practice of the game of golf and specifically in the practice of putting.

In particular, the device allows the repetitive rolling of the golf ball with reference to a given position of the same on the green. In use, after having identified the position of the device on the green which effectively moves the ball from a starting point to an arrival point (in the hole), each ball successively thrown/hit will follow the same path and enter the hole (with same path and speed). The position of the device identifies the player's training station since with it it is possible to verify that, from a given starting point, if the ball is hit with the correct force, and with the face of the putt positioned at a given angle, the ball reaches the pre-established point of arrival, i.e. the hole on that green.

Figure 4A:
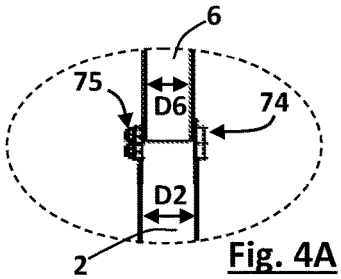
Figure 3:
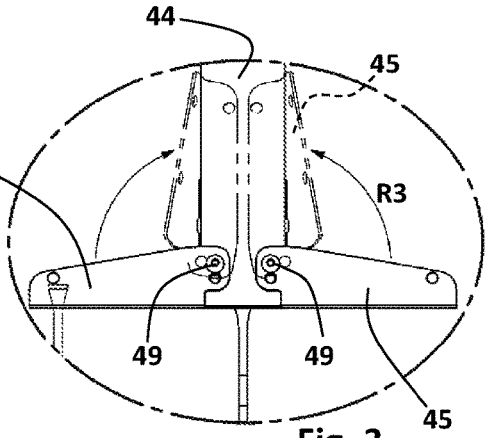
Figure 1:
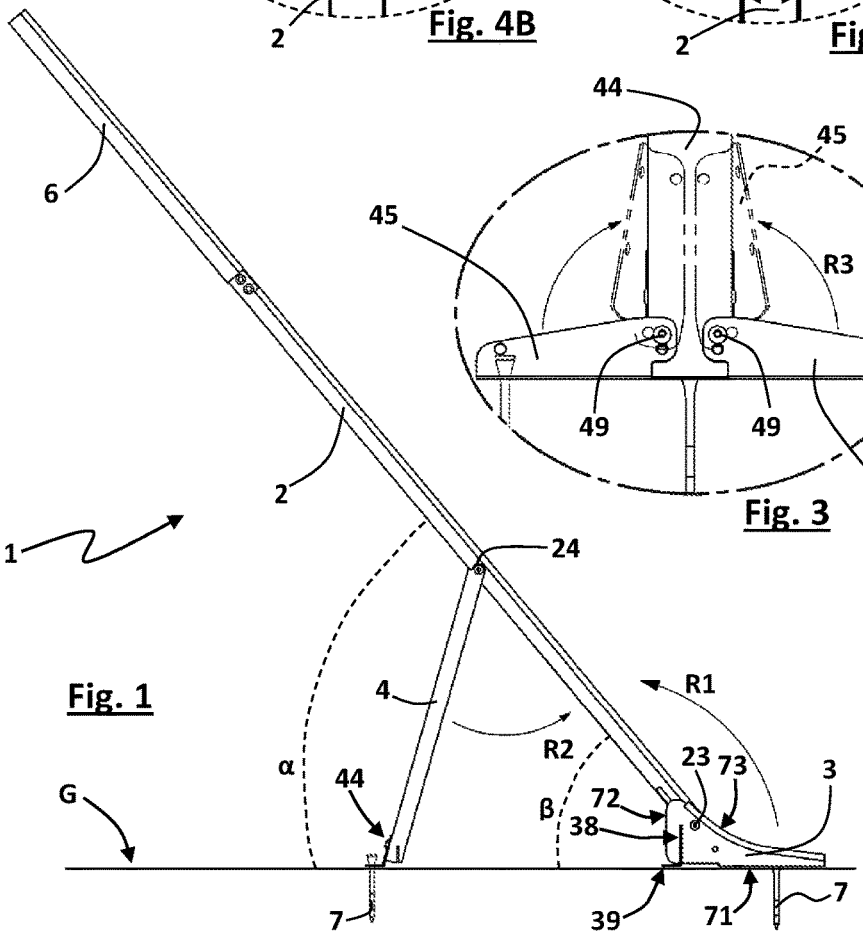
Figure 2:
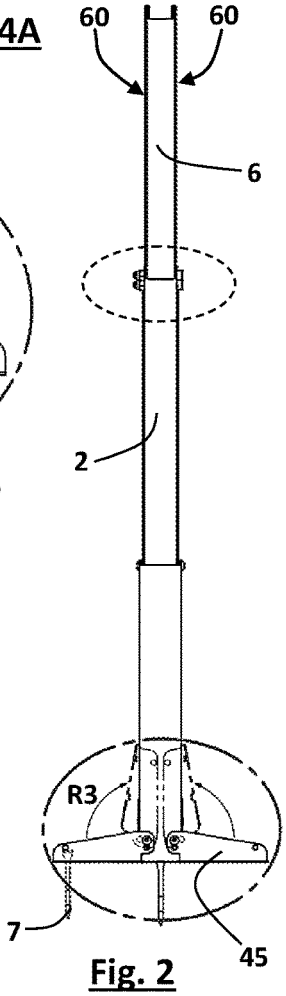
Figure 5:
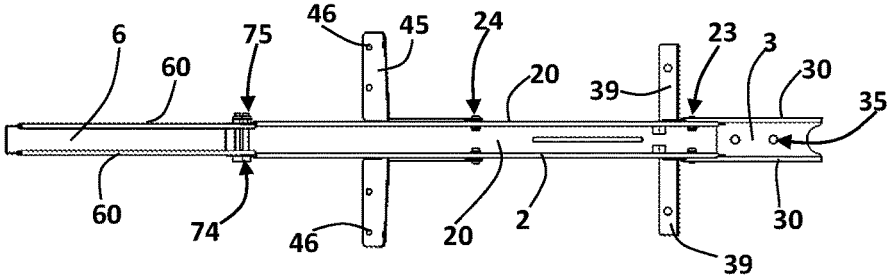
Figure 6:
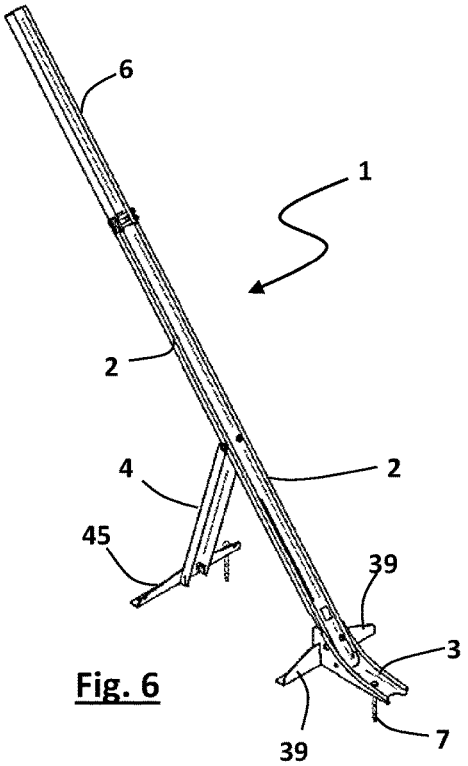
Figure 7:
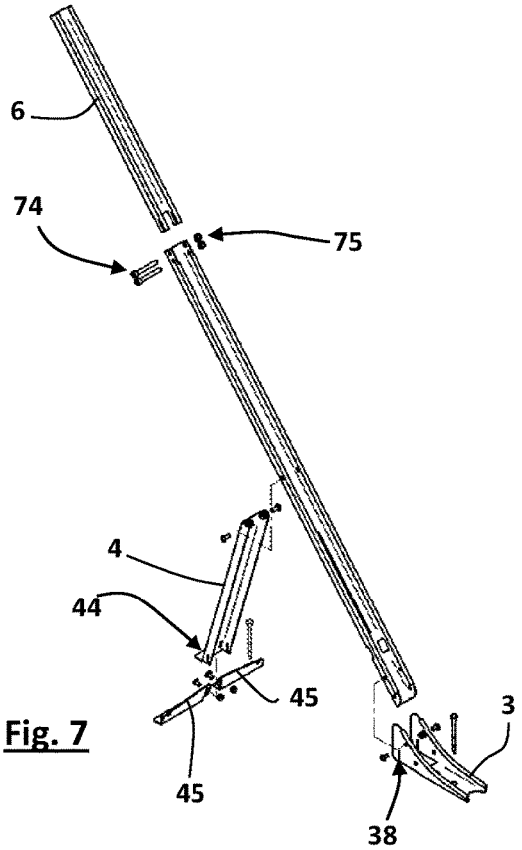
Figure 8:
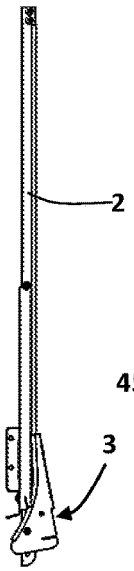
Figure 9:
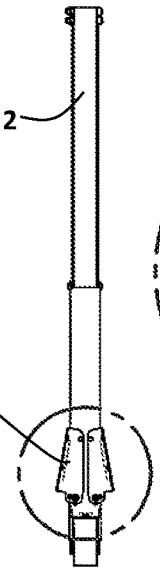
Figure 10:
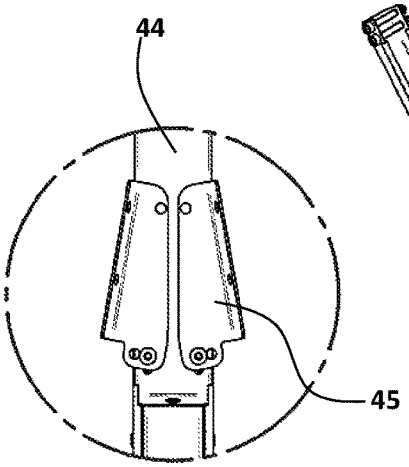
Figure 11:
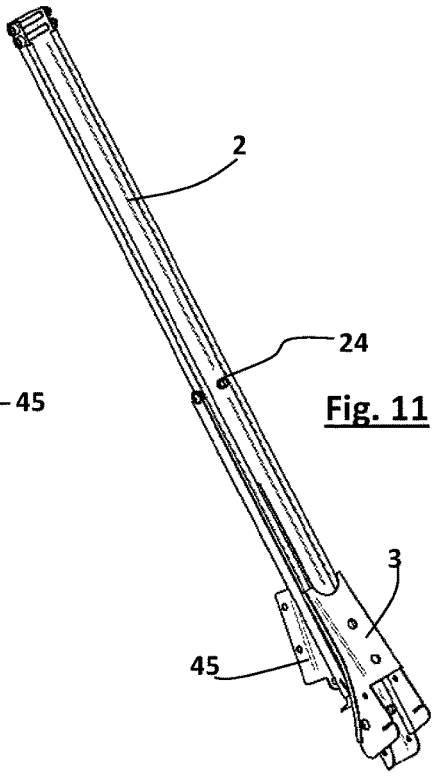
Figure 12:
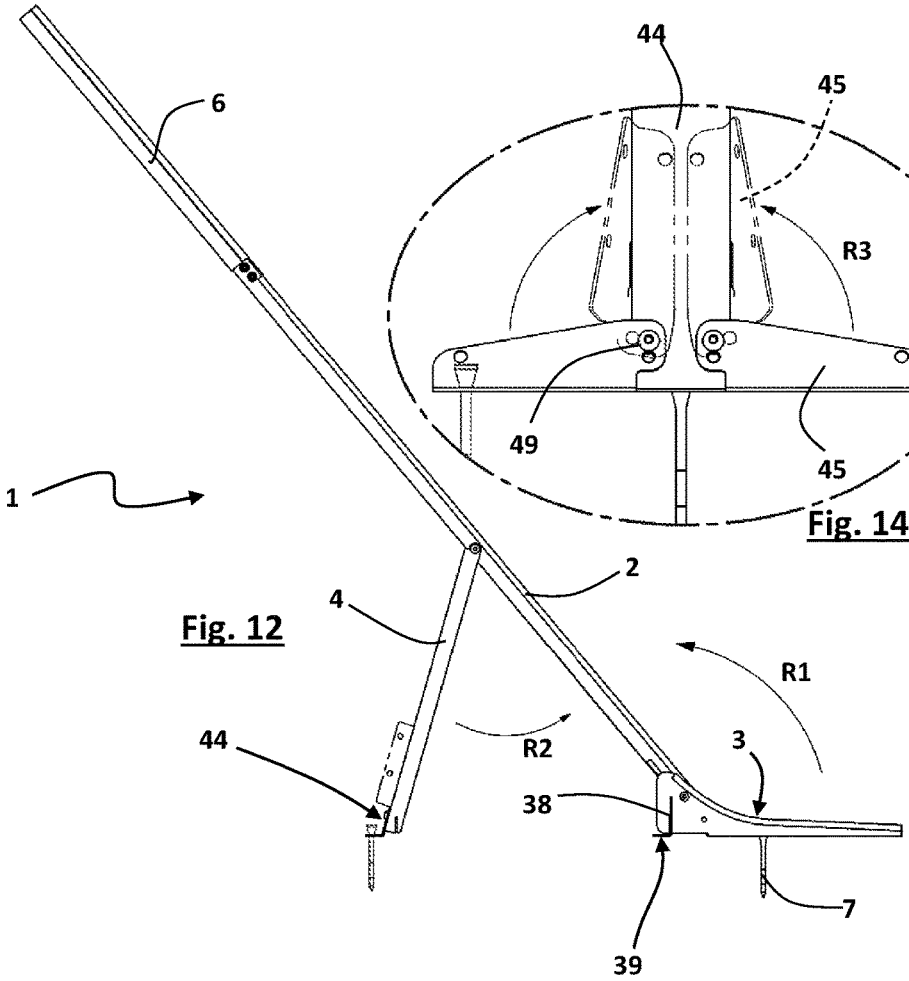
Figure 14:
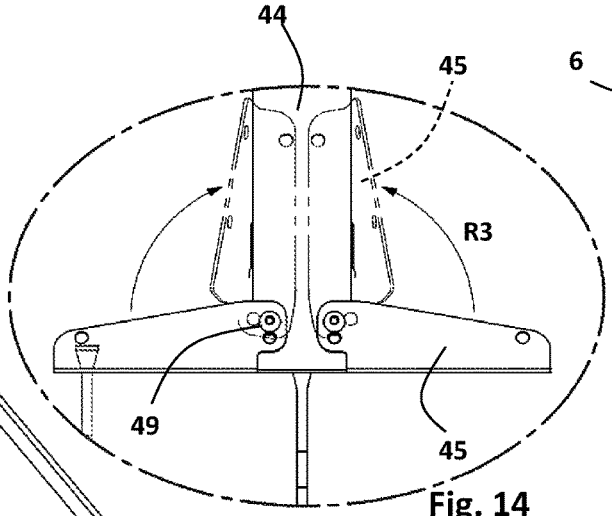
Figure 13:
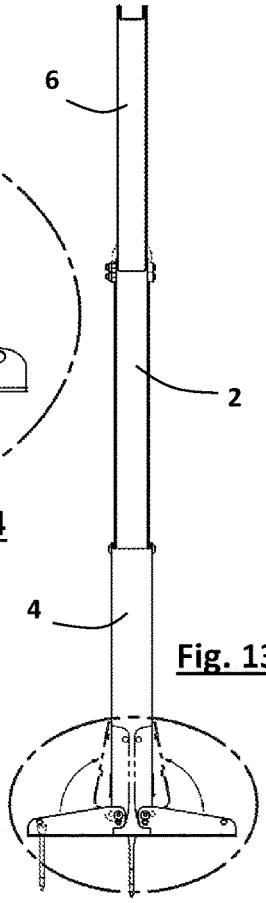
Figure 15:
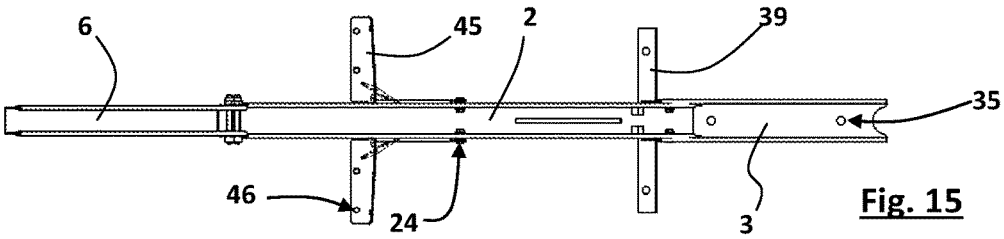
Figure 16:
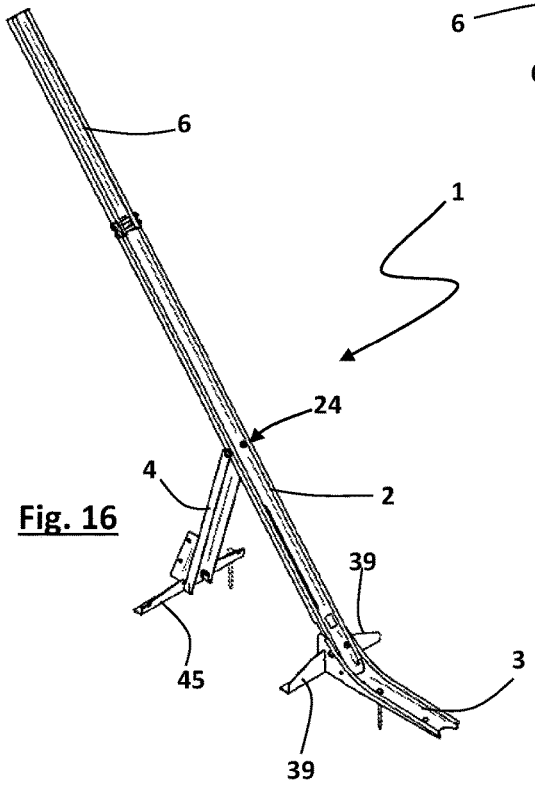
Figure 17:
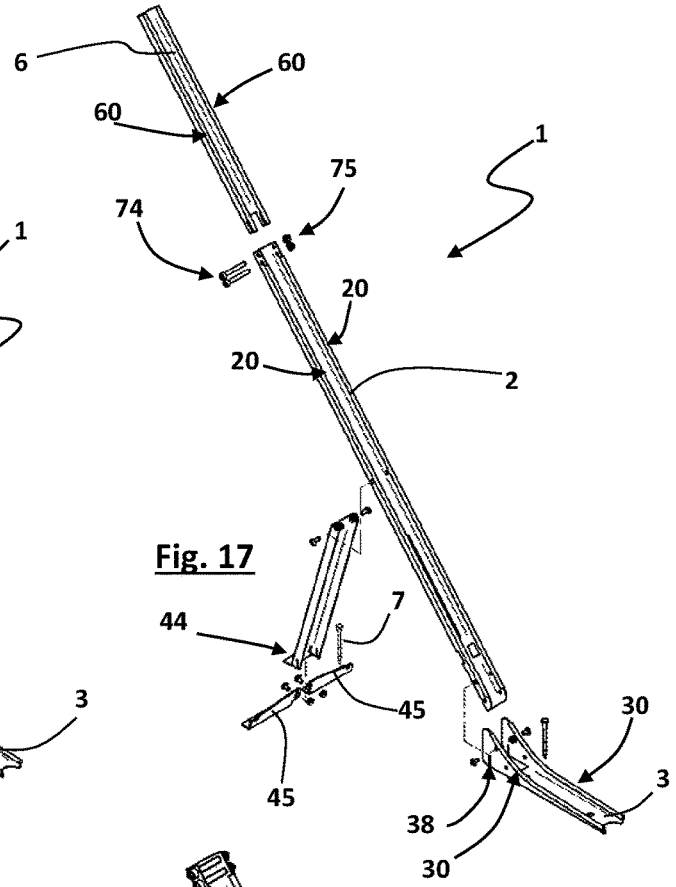
Figure 18:
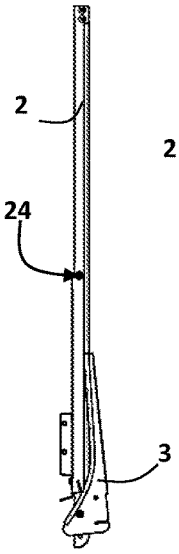
Figure 19:
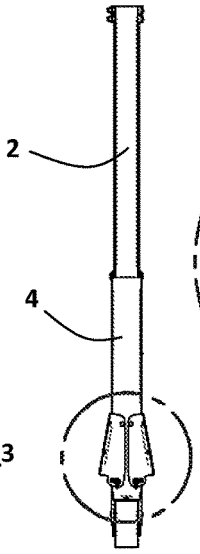
Figure 20:
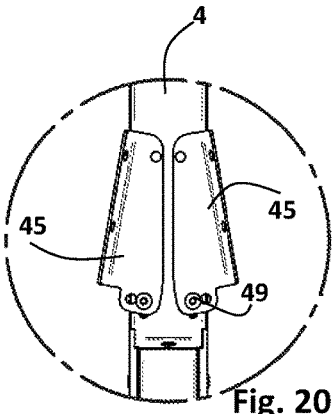
Figure 21:
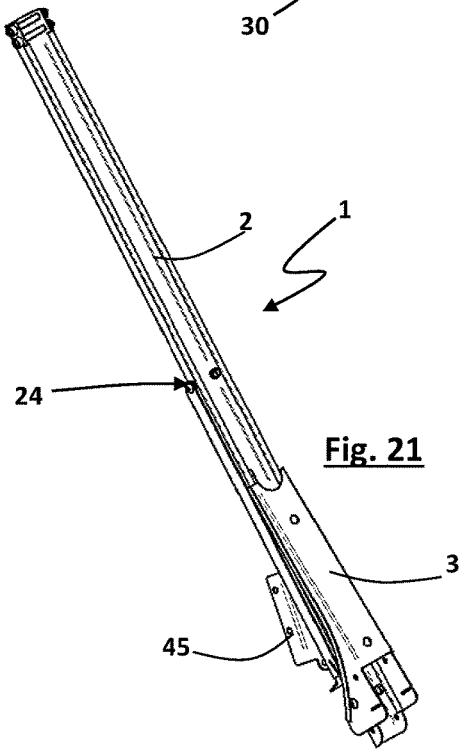
Figure 22:
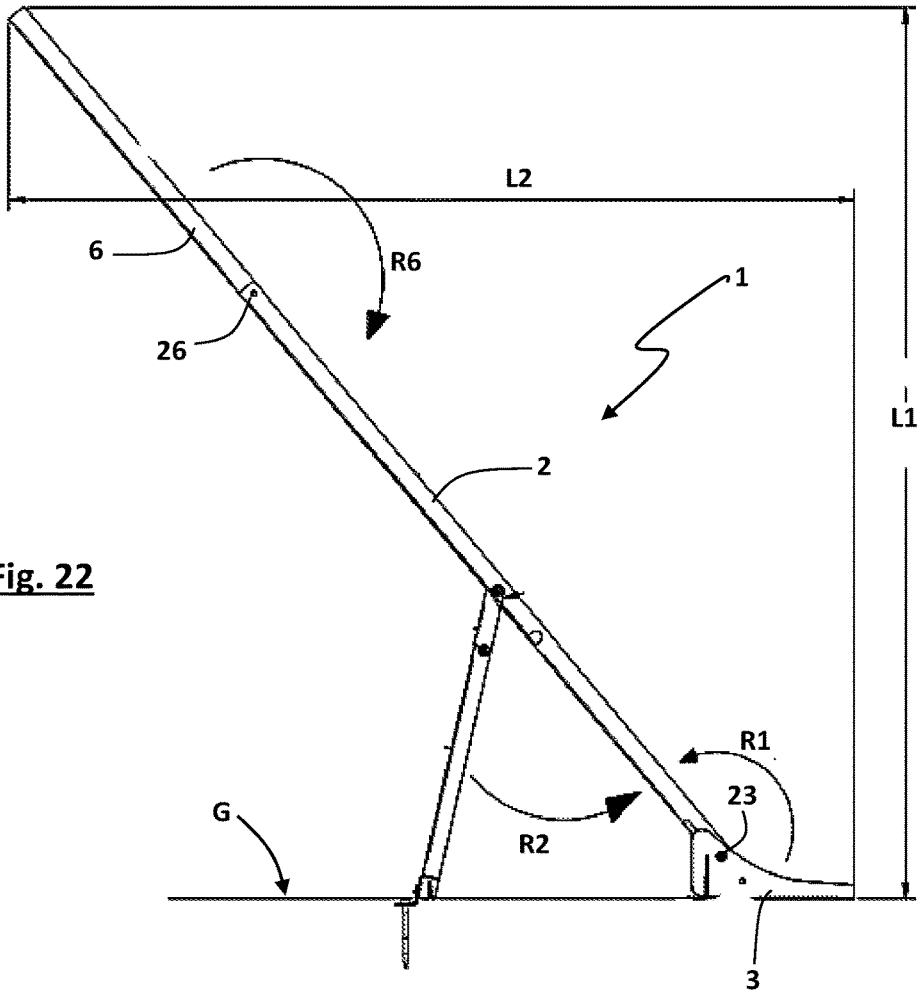
Figure 23:
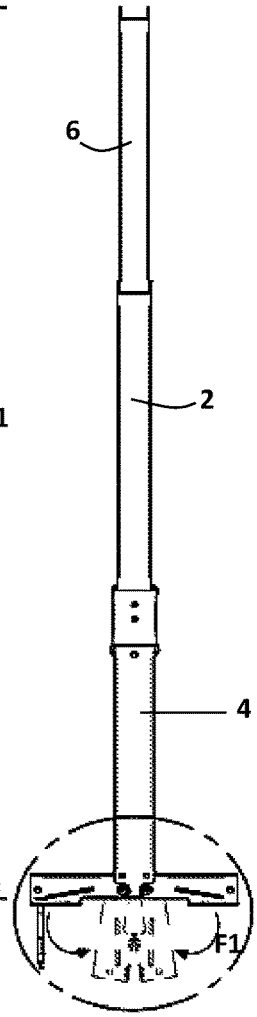
Figure 25:
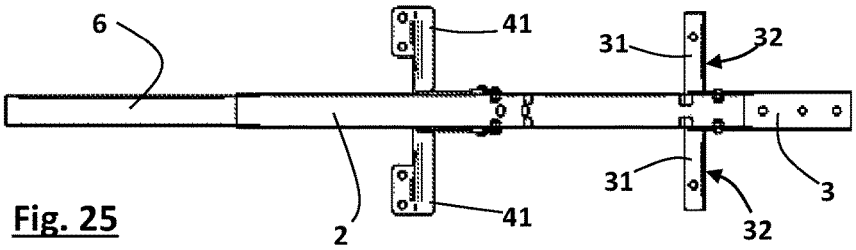
Figure 24:
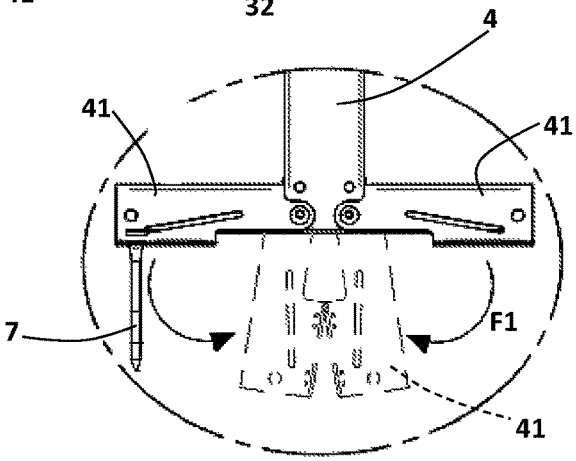
Figure 26:
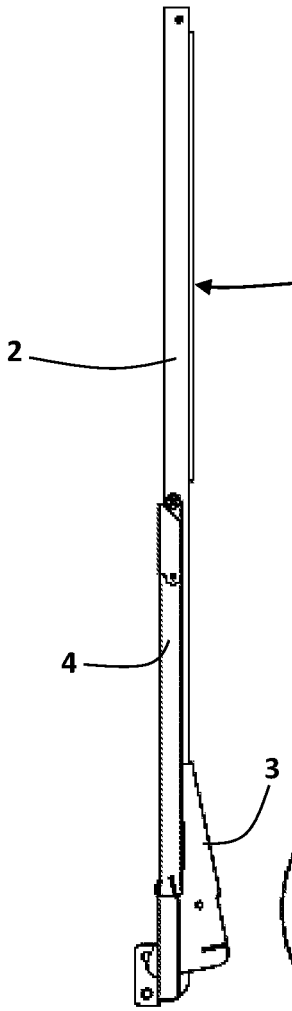
Figure 27:
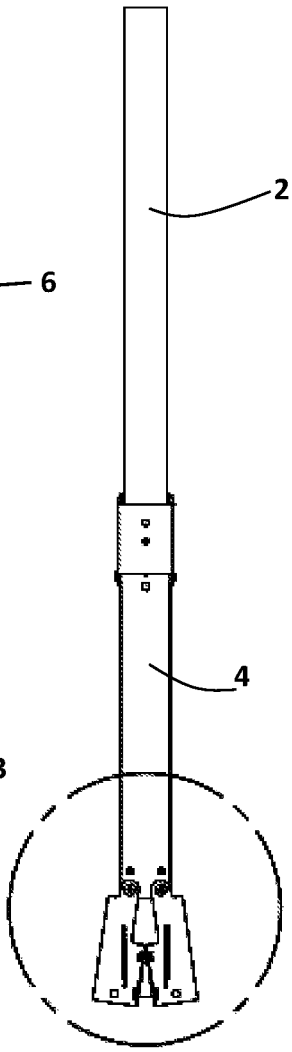
Figure 28:
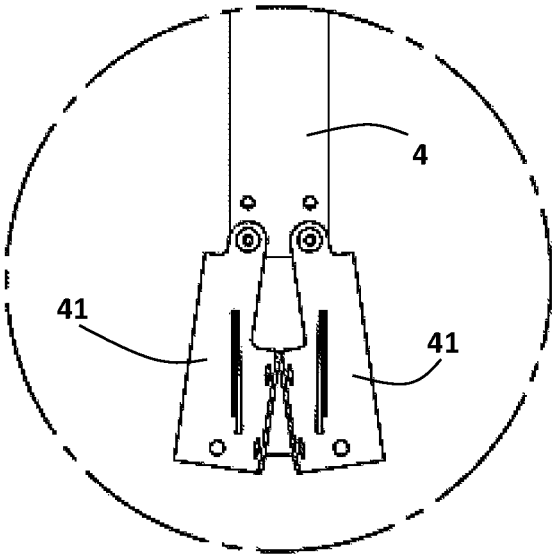
Figure 29:
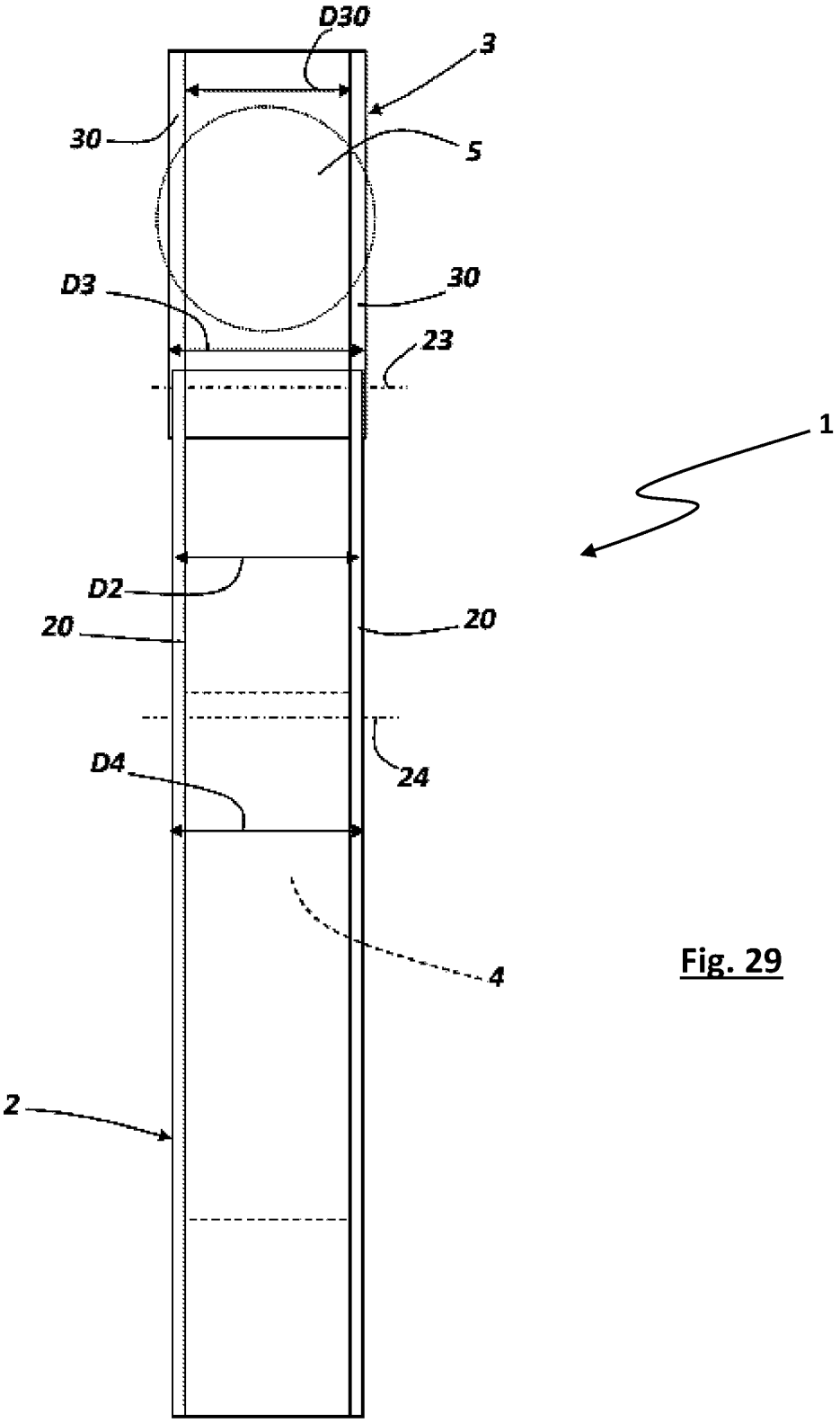

These and further advantages and features of the present invention will be more and better understood by any person skilled in the art from the following description and with the help of the annexed drawings, given as a practical exemplification of the invention, but not to be considered in a limiting sense, in which:

FIGS. 1, 2, 3, 4A, 4B, 5, 6, 7 relate to a possible embodiment of the invention shown in the open configuration, i.e. in the configuration of use; in particular, FIG. is a side view, FIG. 2 is a rear view, FIG. 3 is an enlarged detail of FIG. 2, FIG. 4A is another enlarged detail of FIG. 2, FIG. 4B is an alternative embodiment of the enlarged detail of FIG. 2 shown in FIG. 4A, FIG. 5 is a top plan view, FIG. 6 is a perspective view, FIG. 7 is an exploded perspective view;

FIGS. 8, 9, 10, 11 relate to the embodiment of the invention shown in FIGS. 1-7 shown in the closed configuration, i.e. in the rest or non-use configuration; in particular, FIG. 8 is a side view, FIG. 9 is a rear view, FIG. 10 is an enlarged detail of FIG. 9, FIG. 11 is a perspective view;

FIGS. 12, 13, 14, 15, 16, 17 relate to another possible embodiment of the invention shown in the open configuration, i.e. in the configuration of use; in particular, FIG. 12 is a side view, FIG. 13 is a front view, FIG. 14 is an enlarged detail of FIG. 13, FIG. 15 is a top plan view, FIG. 16 is a perspective view, FIG. 17 is an exploded perspective view;

FIGS. 18, 19, 20, 21 relate to the embodiment of the invention shown in FIGS. 12-17 represented in the closed configuration, or in the rest or non-use configuration; in particular, FIG. 18 is a side view, FIG. 19 is a rear view, FIG. 20 is an enlarged detail of FIG. 19, FIG. 21 is a perspective view;

FIGS. 22, 23, 24, 25 relate to a further possible embodiment shown in the open configuration, i.e. in the configuration for use; in particular, FIG. 22 is a side view, FIG. 23 is a rear view, FIG. 24 is an enlarged detail of FIG. 23; FIG. 25 is a top plan view;

FIGS. 26, 27, 28 relate to the embodiment of the invention shown in FIGS. 22-25 represented in the closed configuration, or in the rest or non-use configuration; in particular, FIG. 26 is a side view, FIG. 27 is a rear view, FIG. 28 is an enlarged detail of FIG. 27; end FIG. 29 is a schematic plan view from above, with parts not to scale to better highlight some details of the device.

With reference to the figures of the attached drawings, the invention relates to a device for playing golf, identified by (1) in its entirety.

As previously expressed, the device (1) is of the type provided with an inclined ramp on which to place a golf ball to determine its rolling in order to measure the speed of a green.

Advantageously, the device (1) comprises a main body (2), a base body (3) and a support element (4), connected to each other as indicated below.

Referring initially to the example of FIGS. 1-21, the main body (2) has a rectilinear development and is provided with a first pair of rails (20) spaced apart by a predetermined value so as to define a guide for rolling the ball. In practice, the two rails (20) are spaced by a value smaller than the diameter of a golf ball (i.e. 1.68 inches, or 42.67 mm) and suitable for allowing the rolling of the same ball. In other words, the distance between the two rails must be less than the diameter of the ball but sufficient to support the same ball as it rolls.

In a possible embodiment, the main body (2) can consist of a profile, for example in metal or plastic material, having a "U"-shaped cross section, with the two arms of the U defined by the first pair of rails (20).

The base body (3) is also provided with a second pair of rails (30) spaced apart by a predetermined value so as to define a guide for rolling the ball and hinged to said main body (2) so as to vary the its configuration with respect to the latter to assume an open or use configuration in which it defines an obtuse angle with the main body (2) and a closed or rest configuration in which it is rotated so as to overlap the main body (2).

Also the base body (3), similarly to the main body (2) can be made up of a profile, for example in metal or plastic material, having a cross section shaped like a "U", with the two arms of the U defined by the rails (30).

The base body (3), seen from the side, substantially has the shape of a right triangle; in particular, the right triangle has a major cathetus (71) which defines the support on the ground, a minor cathetus (72) arranged vertically, and a hypotenuse (73) which has an arcuate profile and defines the terminal part of the rolling ramp for the ball (5). Two notches (38) which house the body of the wings (39), which will be described later, extend orthogonally to said major cathetus (71), i.e. they are parallel to the minor cathetus (72).

In the two possible embodiments of the device (1) represented, respectively, in FIGS. 1-11 and 12-21, the base body (3) is shaped differently. In particular, in the example of FIGS. 1-11 the base body (3) is shorter than the base body (3) of the example of FIGS. 12-21. By way of example, the length of the ramp defined by the device (1) of FIGS. 1-11 is about 80 cm, i.e. about 31.5 inches, while the ramp defined by the device (1) of FIGS. 12-21 is about 115 cm long, i.e. about 45.27 inches.

The support element (4) is hinged to the main body (2) so as to vary its configuration with respect to the latter to assume an open or use configuration in which it defines an angle with the main body (2) and one of its free ends (44) defines a support point and a closed or rest configuration in which it is rotated so that said main body (2) is superimposed on it. It is possible to vary the inclination of the main body (2) with respect to the ground (G) by varying the point at which the end (44) rests on the ground. With reference to FIG. 1, by varying the angle ($\beta$) formed by the support element (4) with the lower part of the main body (2), the angle ($\alpha$) that the main body (2) shape with the ground (G).

As in the attached drawings, the base body (3) can be hinged to the main body (2) around an axis (23) placed transversally with respect to the direction of development of the rails (20, 30).

Also the support element (4) can be hinged to the main body (2) around an axis (24) placed transversally with respect to the direction of development of said rails (20). For the hinging of the main body (2) around the axis (23) with the base body (3) and around the axis (24) with the support element (4) pins, bolts or the like can be used fastening members that define a hinge.

In the embodiments illustrated in FIGS. 1-21, the base body (3) is provided with one or more holes (35) into which a pointed rod-like element (7) can be inserted, suitable for being inserted into the ground (G) to constrain the device (1). The base body (3) is also provided with a body (39) with an "L" profile which can be inserted into corresponding vertical notches (38) of the base body (3) so as to form two wings which project onto the two sides of the basic body (3).

The support element (4) is provided in its lower free end (44) with a pair of wings (45), provided with holes (46) in which a pointed rod-shaped element (7) can be inserted, suitable for being inserted into the ground to secure the device (1). The wings (45), which can have an "L" profile, are hinged to the lower end (44) of the support element (4) by means of two pins (49) which allow the rotation of the same wings (45) with respect to to the support element (4). The pointed elements (7) will be used when the device (1) is used on suitable penetrable/traversable terrain such as, for example, outdoors. On the contrary, for use also extended to indoor activities (i.e. on non-penetrable ground) the device will rest on the wings (45) and (39).

With reference to the schematic drawing of FIG. 29, which refers to the example of FIGS. 1-21, the width (D3) of the base body (3) is greater than that (D2) of the main body (2); in this way the main body (2) can be housed inside the base body (3) when the device (1) is in the closed or rest configuration. In practice, when the device (1) is closed, the "U" of the profile that defines the base body (3) houses the corresponding "U" of the main body (2). In FIGS. 1 and 12 the arrow (R1) indicates the rotation followed by the base body (3) around the axis (23).

Furthermore, the width (D2) of the main body (2) is smaller than that (D4) of the support element (4); in this way the support element (4) houses the main body (2) inside it when the device (1) is in the closed or rest configuration. In practice, when the device (1) is closed, the "U" of the profile of the support element (4) houses the main body (2) inside it. In FIGS. 1 and 12 the arrow (R2) indicates the rotation followed by the support element (4) about the axis (24). As can be seen in the rest configuration shown in the perspective views of FIGS. 10 and 21, the main body (2) is substantially enclosed between the base body (3), located at the front, and the support element (4), located at the rear. In the rest configuration of the device (1) the wings (45) are rotated to take up less space; the rotation of the wings (45) is indicated by the arrows (R3) in FIG. 3 and FIG. 14. In the details shown in FIGS. 3 and 14 (as also in the corresponding FIGS. 2 and 13) the wings (45) are represented in two possible configurations: the use configuration is represented in a continuous line and the rest configuration in a broken line.

In practice, the width (D3) of said base body (3) is greater than that (D2) of said main body (2) so as to accommodate the main body (2) inside the base body (3) when the device (1) is in the closed or rest configuration and the width (D4) of said support element (4) is greater than the width (D2) of said main body (2) so as to accommodate the main body (2) inside the support element (4) when the device (1) is in the closed or rest configuration.

In another possible embodiment, the ratios between the widths (D2), (D3) and (D4) can be different. For example, the width (D3) of said base body (3) can be greater than that (D2) of said main body (2) so as to accommodate the main body (2) inside the base body (3) when the device (1) is in the closed or rest configuration and the width (D4) of said support element (4) is instead smaller than the width (D2) of said main body (2) so that it is the main body (2) to house the support element (4) inside it when the device (1) is in the closed or rest configuration.

The device (1) can advantageously be provided with an extension element (6) of the main body (2), connected to the same main body (2) in the opposite end with respect to that in which the hinge (23) is arranged which connects the main body (2) to the base body (3). The extension element (6) is also provided with a third pair of rails (60) able to define a guide for the rolling of the golf ball (5).

In the solution of FIGS. 1-21, the extension element has a width (D6) smaller than the width (D2) of the main body. In this way the "U" which defines the section of the extension element (6) can be inserted inside the "U" of the main body (2). The locking of the two portions of the extension element (6) and of the main body (2) can be achieved by one or more bolts (74) which can be locked by corresponding nuts (75) as better visible in the detail of FIG. 4A. Alternatively, differently shaped means can be provided, such as one or more spring bars (76) like those shown in FIG. 4B, i.e. formed a telescopic metal pin, which expands elastically, similar to those used for watch straps. For receiving the spring bars (76) corresponding through holes will be provided on the main body (2) and on the extension element (6).

The embodiment illustrated in FIGS. 22-28 differs in some features with respect to the device represented in the examples of FIGS. 1-21. In the solution of FIGS. 22-28 the extension element (6) of the main body (2) is connected to the same main body (2) at the end of said body opposite to that in which the hinge (23) connecting the main body is arranged (2) to the base body (3). Also in this case the extension element (6) is provided with rails (60) able to define a guide for the rolling of the golf ball (5).

In this solution, the device (1) is provided with a hinge (26) which connects the main body (2) with the extension element (6). Similarly to what is foreseen for the hinges (23) and (24), the revolving connection between the main body (2) and the extension element (6) can be realized by a pair of pins which can be inserted in corresponding seats provided on the superimposable edges presented by the same main body (2) and by the extension element (6).

As for the examples previously described, in FIG. 22 the arrow (R1) indicates the rotation followed by the base body (3) around the axis (23) and the arrow (R2) indicates the rotation followed by the support element (4) around the axis (24). Also, the arrow (R6) indicates rotation followed by the extension element (6) with respect to the main body (2).

In FIG. 22 the arrows (L1) and (L2) indicate two possible dimensional values of the device, which can be, by way of non-limiting example, (L1) between 850 and 950 mm, for example 903 mm, or about 35.55 inches, and (L2) between 800 and 900 30 mm, for example 857 mm, or about 33.74 inches.

As visible also from the configurations represented in FIGS. 3 and 6, it is possible to vary the inclination of the device (1) by varying the angle formed between the main body (2) and the support element (4).

In this embodiment of the invention, the base body (3) and the support element (4) are provided with perforated portions which can be crossed by tees or similar pointed rod-like elements (7) for fixing to the ground.

In particular, the base body (3) is formed by a shaped body to which two wings (31) can be fixed, which in the example are formed by a single laminar element (31), having an "L" profile.

The shaped body (3) is formed by a flat central portion from which two parallel lateral portions extend having the free edges (30) in a curved shape so as to define the lower end part of the ramp for launching the ball (5).

The laminar element (31) which defines the support wings for the base element (3) has two vertical portions (32) which can be reversibly inserted into corresponding notches (34) provided on the shaped body (3). The laminar element (31) has a substantially L-shaped cross section with a base portion intended for resting on the ground.

The holes for the passage of the tees can be provided both on the lower part of the shaped base body (3) and on the base portion of the laminar element (31).

In the embodiment of FIGS. 22-28, the support element (4) is provided with its wings (41) which are hinged to the support element (4) so as to be able to assume at least one active configuration in which they form corners upright with the support element (4) and a rest configuration in which the wings (41) are folded and brought closer to each other.

FIG. 24 shows a detail of FIG. 23 in two configurations. The drawing shows both the active configuration (in continuous line) in which the wings (41) form angles of substantially 90° with the support element (4) determining the support on the ground and the closed or rest configuration (in discontinuous section) in which the wings (41) are gathered to reduce the encumbrance. The arrows (F1) move the wings (41) (downwards) in the closing movement.

Similarly to the previous examples, the support element (4) has a body with longitudinal development which substantially has the function of a strut which is fixed to the main body (2) at the top and which is joined to the wings (41) at the bottom by means of a connection which allows the rotation of the same wings (41) with respect to the strut.

In all embodiments, the support element (4) may not be provided with support wings but have its own end shaped so as to constrain the device (1) to the ground. For example, the support element can have a tapered end adapted to be inserted into the ground or a flat end to define a support.

In all possible embodiments of the invention, the edges of the main body (2), as well as those of the possible extension element (6) and those of the base body (3), intended for contact with the ball (5), they are coated in a material with a relatively high coefficient of friction such as, for example, rubber or silicone. The coating can be made by applying rubber or other suitable material, for example by gluing or interference fit. Rubber gaskets or suitable material can also be made to fit on the edges of the main body (2) and/or the base body (3) and/or the extension element (6). In practice, the edges of the "U" profile of the extension element (6), of the main body (2) and of the base body (3) define the rails (60, 20, 30) which form the rolling guide for the ball (5) and their interaction with the ball (5) may involve the use of a material or treatment that improves the friction between the rails and the ball. In other words, the treated rails are anti-slip.

In a possible example of use, once a trajectory with which the golf ball goes from a given starting position to a given finish position has been identified, the ball will be positioned (and the position will be marked with a reference element for subsequent trials) at the end of the ramp onto the green. Then the device will be removed and the golfer will be in a parallel position with respect to the previous position of the device (i.e. with the face of the putt which in turn will be perpendicular to the previous position of the device 1) and will do many repetitions with the ball to train speed to be imprinted on the ball itself to reproduce the effective path previously identified by the device.

In other words, the aim of using the device is to improve the performance of the putt, training the speed that the latter will have to give to the ball itself in the presence of any slope of the ground of the green and with any speed of the green. In practice, the execution details can in any case vary in an equivalent manner in the shape, dimensions, arrangement of the elements, nature of the materials used, without however departing from the scope of the adopted solution idea and therefore remaining within the limits of the protection granted by the present patent as determined by the following claims.

The invention claimed is:

1. A golf practice device comprising an inclined ramp on which to place a golf ball to determine its roll in order to measure the speed of a green, wherein the device (1) comprises:

a main body (2) with rectilinear development provided with a first pair of rails (20) spaced apart by a predetermined value so as to define a guide for rolling the ball;

a base body (3), also provided with a second pair of rails (30) spaced apart by a predetermined value so as to define a guide for rolling the ball and hinged to said main body (2) so as to vary its configuration with respect to the main body to assume an open or use configuration in which it defines an obtuse angle with the main body (2) and a closed or rest configuration in which it is rotated so as to overlap the main body (2) or adjacent to the latter; and a support element (4) having hinged ends at a first end of the support element, and, free ends (44) at a second end of the support element, opposite to the first end, the hinged ends being hinged to said main body (2) so as to vary a configuration of the support element with respect to the main body to assume an open or use configuration in which the support element defines an angle with the main body (2) and one of its free ends (44) defines a support point and a closed or rest configuration in which the support element is rotated so that said main body (2) is superimposed on the support element or adjacent to the support element, wherein a width (D3) of said base body (3) is greater than a width (D2) of said main body (2) so as to accommodate the main body (2) at an interior of the base body (3) when the device (1) is in the closed or rest configuration.

2. The golf practice device according to claim 1, wherein said base body (3) has a substantially right-angled triangular profile with a major cathetus intended for contact with the ground, a minor cathetus arranged vertically and an hypotenuse which develops rounded in such a way to define a terminal part of this ramp.

3. The golf practice device according to claim 1, wherein the device comprises an extension element (6) of said main body (2), also provided with a third pair of rails (60) spaced apart by a predetermined value so as to define a guide for rolling the ball and fixed to said main body by means of resolvable fixing means.

4. The golf practice device according to claim 1, wherein the device comprises an extension element (6) of said main body (2), also provided with a third pair of rails (60) spaced apart by a predetermined value so as to define a guide for rolling the ball and fixed to said main body by means of resolvable fixing means consisting of a portion of said extension element (6) which are inserted into a corresponding portion of said main body (2) and of one or more nut and bolts disposed and acting between said portions of the extension element and the main body.

5. The golf practice device according to claim 1, wherein the device comprises an extension element (6) of said main body (2), also provided with a third pair of rails (60) spaced apart by a predetermined value so as to define a guide for rolling the ball and fixed to said main body by means of resolvable fixing means consisting of a portion of said extension element (6) which are inserted into a corresponding portion of said main body (2) and of one or more bars springs disposed and acting between said portions of the extension element and the main body.

6. The golf practice device according to claim 1, wherein the device (1) comprises an extension element (6) of said main body (2), extension element (6) which is hinged to said main body (2) and also provided with a third pair of rails (60) spaced apart by a predetermined value so as to define a guide for rolling the ball.

7. The golf practice device according to claim 1, wherein the device (1) comprises an extension element (6) of said main body (2), an extension element (6) which is hinged to said main body (2) and also it is provided with a third pair of rails (60) spaced apart by a predetermined value so as to define a guide for rolling the ball and in which said extension element (6) is hinged to said base body (2) around an axis (26) placed transversally with respect to the direction of development of said rails (20, 30, 60).

8. The golf practice device according to claim 1, wherein said base body (3) is hinged to said main body (2) around an axis (23) placed transversely with respect to the direction of development of said rails (20, 30) and said support element (4) is hinged to said main body (2) around an axis (24) placed transversally with respect to the direction of development of said rails.

9. The golf practice device according to claim 1, wherein said support element (4) is hinged to said main body (2) around an axis (24) placed transversely with respect to the direction of development of said rails (20).

10. The golf practice device according to claim 1, wherein said base body (3) and said support element (4) are provided with perforated portions which can be crossed by a pointed rod-like element (7) which are inserted into the ground to constrain the device (1).

11. The golf practice device according to claim 1, wherein said main body (2), said base body (3), and said support element (4) are formed by "U" shaped sections.

12. The golf practice device according to claim 1, wherein said first pair of rails (20) of the main body (2) and said second pair of rails (30) of the base body (3) are lined with high friction coefficient material, i.e. anti-slip.

13. The golf practice device according to claim 1, wherein the device comprises an extension element (6) of said main body (2), also provided with a third pair of rails (60) spaced apart by a predetermined value so as to define a guide for rolling the ball and fixed to said main body by means of resolvable fixing means, and wherein said main body (2), said base body (3), said support element (4) and said element extension are formed by "U" profiles.

14. The golf practice device according to claim 1, wherein the device comprises an extension element (6) of said main body (2), also provided with a third pair of rails (60) spaced apart by a predetermined value so as to define a guide for rolling the ball and fixed to said main body by means of resolvable fixing means, and wherein said first pair of rails (20) of the main body (2), said second pair of rails (30) of the body base (3) and said third pair of rails (60) of the extension element (6) are coated with a material with a high friction coefficient, i.e. anti-slip.

15. The golf practice device according to claim 1, wherein the width (D4) of said support element (4) is greater than the width (D2) of said main body (2) so as to accommodate the main body (2) inside the support element (4) when the device (1) is in the closed or rest configuration.

* * * * *